US007980035B1

(12) United States Patent
D'Apolito et al.

(10) Patent No.: US 7,980,035 B1
(45) Date of Patent: Jul. 19, 2011

(54) FOUNDATION WALL MOISTURE ABATING VENT AND SYSTEM

(76) Inventors: Anthony D. D'Apolito, Canfield, OH (US); Anthony D. D'Apolito, Jr., Austintown, OH (US); Amato D. D'Apolito, Girard, OH (US)

( * ) Notice: Subject to any disclaimer, the term of this patent is extended or adjusted under 35 U.S.C. 154(b) by 0 days.

(21) Appl. No.: 12/313,283

(22) Filed: Nov. 19, 2008

(51) Int. Cl.
*E04B 7/00* (2006.01)
*E04F 17/00* (2006.01)

(52) U.S. Cl. ..... 52/302.1; 52/198; 52/302.7

(58) Field of Classification Search ..... 52/302.7, 52/302.1, 302.4, 198–199
See application file for complete search history.

(56) References Cited

U.S. PATENT DOCUMENTS

| | | | | |
|---|---|---|---|---|
| 761,711 | A | 6/1904 | Redfern | |
| 2,657,570 | A | 11/1953 | Moore | |
| 2,931,215 | A | 4/1960 | Rose | |
| 3,429,084 | A | 2/1969 | Brewer | |
| 4,159,673 | A | 7/1979 | Weirich | |
| 4,587,891 | A * | 5/1986 | Kruse | 454/271 |
| 5,487,247 | A * | 1/1996 | Pigg | 52/302.3 |
| 5,560,163 | A * | 10/1996 | Carlton | 52/169.5 |
| 5,634,311 | A * | 6/1997 | Carlton | 52/577 |
| 5,685,290 | A * | 11/1997 | Collins et al. | 126/518 |
| 6,165,066 | A * | 12/2000 | Sharp et al. | 454/273 |
| 6,244,006 | B1 * | 6/2001 | Shue et al. | 52/302.1 |
| 6,669,404 | B2 * | 12/2003 | Le Blanc | 405/36 |
| 6,792,726 | B1 * | 9/2004 | Price | 52/220.8 |
| 7,080,486 | B2 * | 7/2006 | Radke et al. | 52/98 |
| 7,549,258 | B2 * | 6/2009 | Lajewski | 52/220.8 |
| 7,571,938 | B2 * | 8/2009 | Yeager et al. | 285/230 |
| 2005/0155304 | A1 * | 7/2005 | Hung | 52/302.1 |
| 2008/0028695 | A1 * | 2/2008 | Fennell | 52/169.5 |
| 2008/0028696 | A1 * | 2/2008 | Fennell | 52/169.5 |

* cited by examiner

*Primary Examiner* — Eileen Lillis
*Assistant Examiner* — Elizabeth A Plummer
(74) *Attorney, Agent, or Firm* — Harpman & Harpman

(57) ABSTRACT

A venting device and system for subterranean basement structure walls to provide interior wall flow-through ventilation. Multiple venting devices are positioned strategically in the wall at intervals there along in an inter-dependent pattern allowing for convection intake and outflow of ambient interior air through the walls. The venting devices define a continuous insertable conduit with size specific restriction exposed end access fixtures. The strategic placement of the venting devices facilitates thermal exchange and creates a homeostatic static temperature and dew point between communicating spaces by means of pressure differential, air density and temperatures.

1 Claim, 5 Drawing Sheets

FOUNDATION WALL MOISTURE ABATING VENT AND SYSTEM

BACKGROUND OF THE INVENTION

1. Technical Field

This invention relates to venting devices that are used to provide air circulation through hollow block and like wall construction. Such walls are below grade and are prone to moisture buildup and associated dampness which can promote the growth of unhealthy airborne mold and mildew.

2. Description of Prior Art

Prior art devices of this type have been relied on a variety of ventilating wall elements and inserts, see U.S. Pat. Nos. 761,711, 2,657,570, 2,931,215, 3,429,084, 4,159,673, 4,656,802, 4,910,937, and 6,912,820. U.S. Pat. No. 761,711 is directed to a ventilating-wall construction in which custom-molded building bricks are provided with interconnected venting passageways when in a wall configuration. Venting portals are provided in some bricks for inlet air flow.

U.S. Pat. No. 2,657,570 discloses rectangular flat sheet wall ventilators that are fitted into the joints between the blocks during construction.

U.S. Pat. No. 2,931,215 claims the combination of tie-down and wall ventilators that comprises a hollow stake that is positioned vertically inside the block wall, extending between adjacent blocks with upstanding retainment tongues engageable on the block surfaces forming an anchor.

U.S. Pat. No. 3,429,084 shows an insect-proof weep hole of a Z-shape conduit with a screened insert therein. The device is positioned in the mortar joint between the blocks allowing for moisture transfer from behind the wall.

U.S. Pat. No. 4,159,673 discloses a vent block having a plurality of adjacent vent holes with an air duct in communication therewith respectively.

A vent pipe configuration for block walls can be seen U.S. Pat. No. 4,656,802 having a screened end cap for positioning in the tops of the block wall cavities.

In U.S. Pat. No. 6,912,820 a drainage system for concrete masonry wall construction is disclosed, having a tray unit with a strip of water permeable material attached which provides a water conduit from the interior of the wall.

SUMMARY OF THE INVENTION

A venting apparatus and method of placement installation for hollow block basement walls that utilize a series of tubular conduits inserted through corresponding apertures formed in the walls. Multiple vent conduits are sequentially positioned at different wall heights and longitudinal spacing imparting a convection flow-through ventilation of the wall. Each venting device has integrated retainment elements and a restrictive size barrier to allow only fluid gas transfer there through preventing moisture buildup and associated dampness on the interior of the wall.

DETAILED DESCRIPTION OF THE PREFERRED EMBODIMENT

Figure 1:
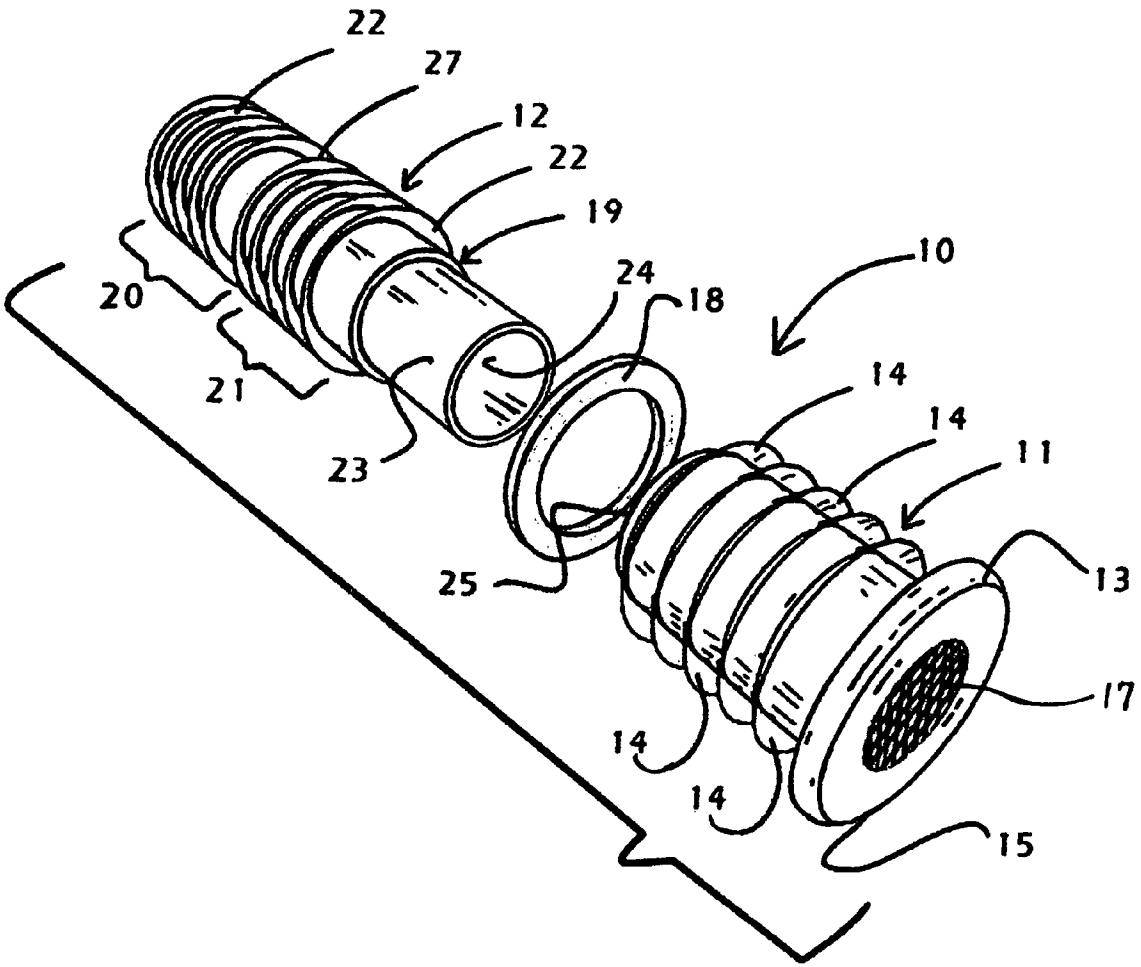
FIG. 1 is an exploded perspective view of the primary venting device with an extension element and gasket position for engagement therewith.

Referring to now to FIG. 1 of the drawings, a basement wall venting device 10 of the invention can be seen having a primary venting body 11 and adjustable extension body 12. The primary venting body 11 is of a cylinder configuration with a wall engagement annular end flange 13 and a plurality of flexible annular sealing flanges 14 positioned in longitudinally spaced relationship to one another thereabout in space relation to the end flange 13. The multiple sealing engagement flanges 14 are of an equal annular dimension each having an annular orientation to the longitudinal axis of the cylinder venting body 11. The end flange 13 extends at right angles from the venting body 11 having a contoured perimeter outer edge 15. An annular recess 16 is formed in the inner engagement surface of the flange 13 inwardly of its hereinbefore described perimeter edge 15 into which an annular sealing gasket 18 is positioned. The sealing gasket 18 will insure a seal between the venting body 11 and the interior wall surface through which it is inserted. In this example, the sealing gasket 18 is of a butyl sealant with a release sheet (not shown) as it is well-known and understood by those skilled in the art.

Figure 4:
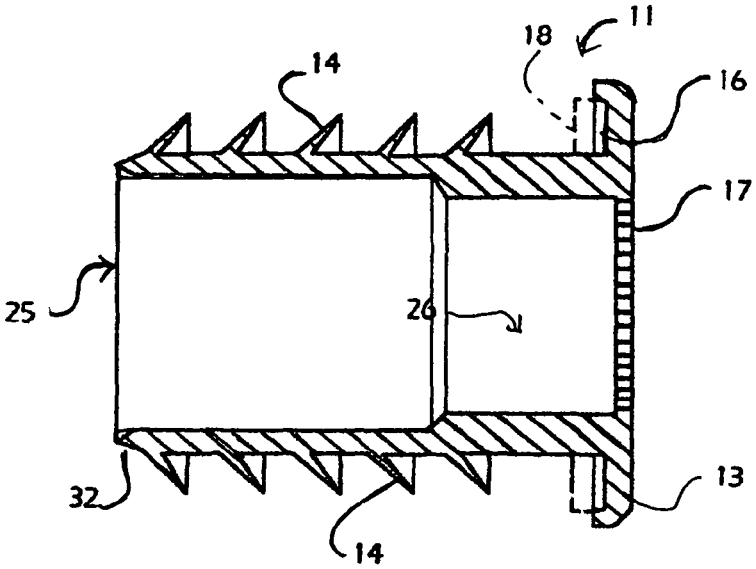
FIG. 4 is an enlarged sectional view of the primary venting device of the invention.
Figure 5:
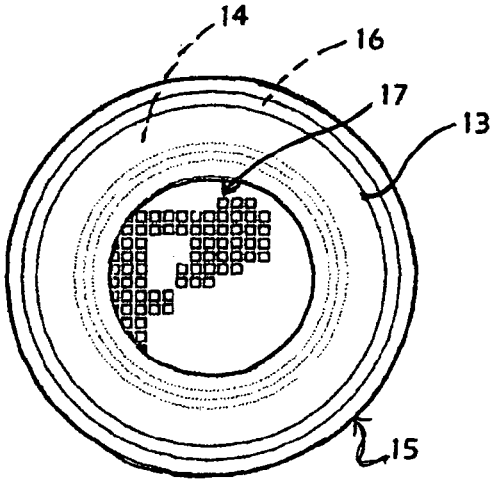
FIG. 5 is an enlarged front elevational view on Lines 5-5 of FIG. 2.
Figure 6:
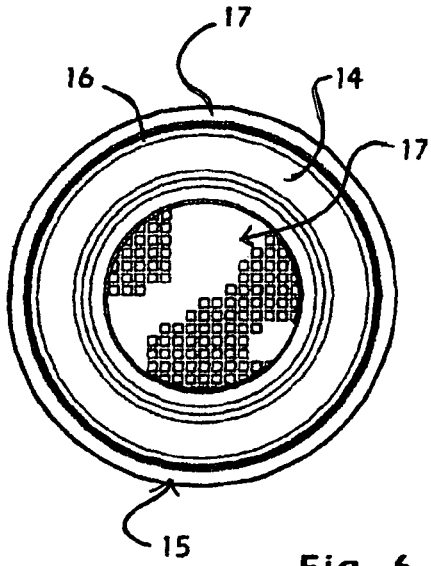
FIG. 6 is an enlarged rear elevational view on Lines 6-6 of FIG. 2.

Referring now to FIGS. 4 and 5 of the drawings, a venting lattice 17 is formed within the opening of the end flange 13 of the primary venting body 11 defining a mesh surface of equal sized aligned openings. The venting lattice 17 is preferably molded intricately but may be formed of any suitable mesh material having similar aperture dimensions to provide a barrier to insects and the like without restricting the thermatic flow of gas therethrough as will be disclosed in greater detail hereinafter.

Figure 2:
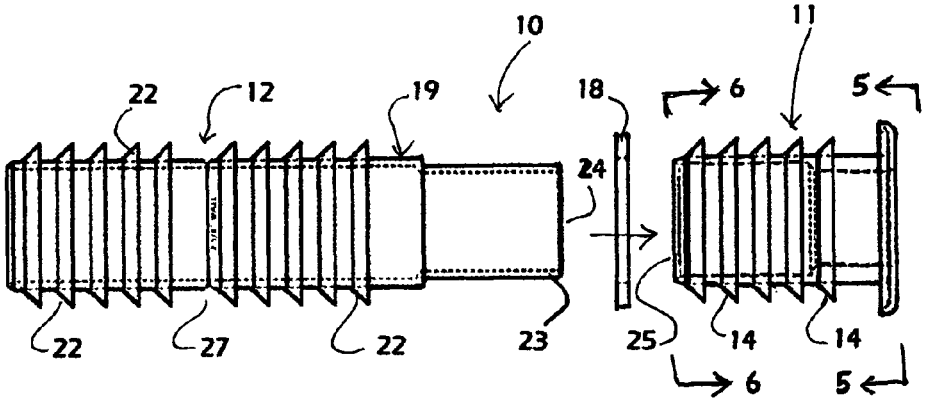
FIG. 2 is an exploded side elevational view thereof.
Figure 3:
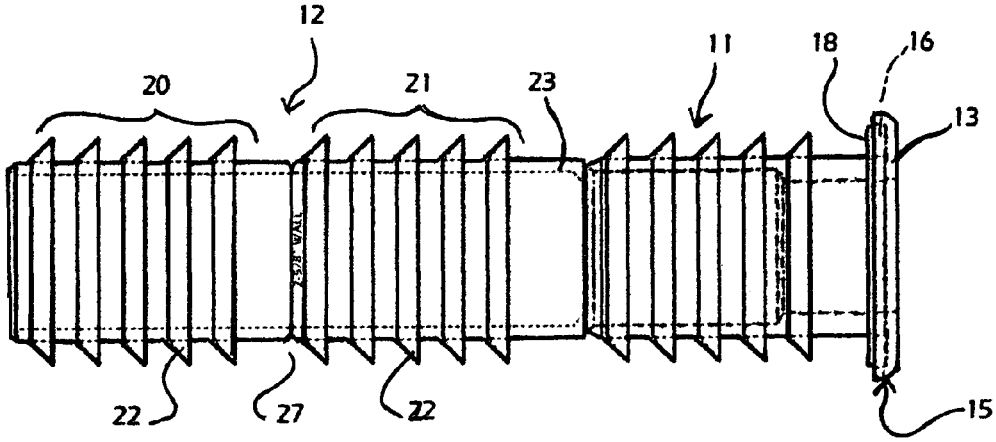
FIG. 3 is a side elevational view of the venting device with the extension element attached.

The adjustable extension body 12 is always used in conjunction with the vent body 11 to extend its effective length, best seen in FIGS. 1-3 of the drawings. The adjustable extension body 12 is of a corresponding cylindrical configuration with a central body 19 having two areas 20 and 21 on which multiple longitudinally spaced flexible annular angular sealing flanges 22 extend therefrom. The sealing flanges 22 are of an identical configuration to that of said venting body flanges 13 so as to provide retainment and sealing for the extension body 12 within an applied mounting opening B in the wall W surface as seen in FIG. 9 of the drawings.

The extension body 12 has an area of reduced annular dimension at 23 extends inwardly from the fitting engagement end 24 to allow for insertion into a corresponding open end 25 of the vent body 11 as seen in FIG. 3 of the drawings. It will be noted that the length of this reduced diameter portion 23 is equal to an interior receiving area 26 best seen in FIG. 4 of the drawings for a frictional retainment fit there within.

Figure 9:
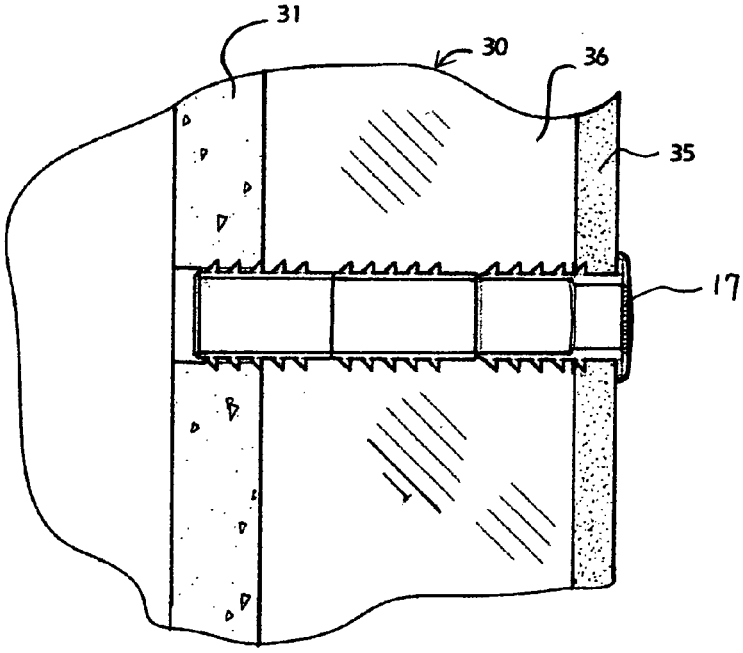
FIG. 9 is a partial sectional view showing an installed venting device of the invention in a third alternate wall construction.

The extension body 12 has an annular bevel 27 thereabout designing a "cut" indicator band at 27 located between the respective flange areas 20 and 21 to foreshorten and provide different vent length combinations to accommodate different wall-mount depth configurations as illustrated in FIG. 9 of the drawings, as will be described hereinafter.

Figure 7:
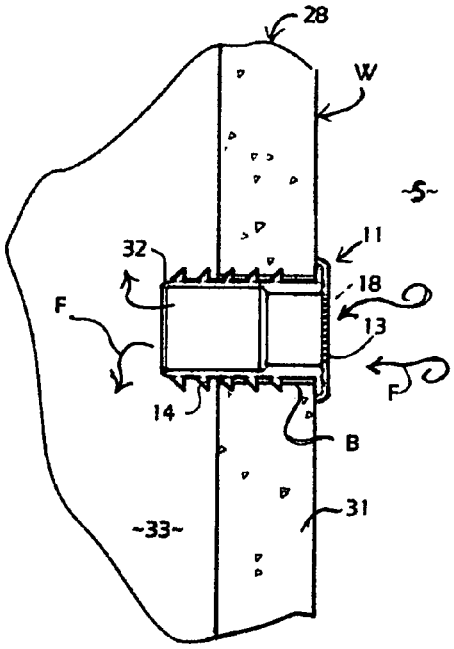
FIG. 7 is a partial sectional view showing an installed venting device in a basic block wall construction.
Figure 8:
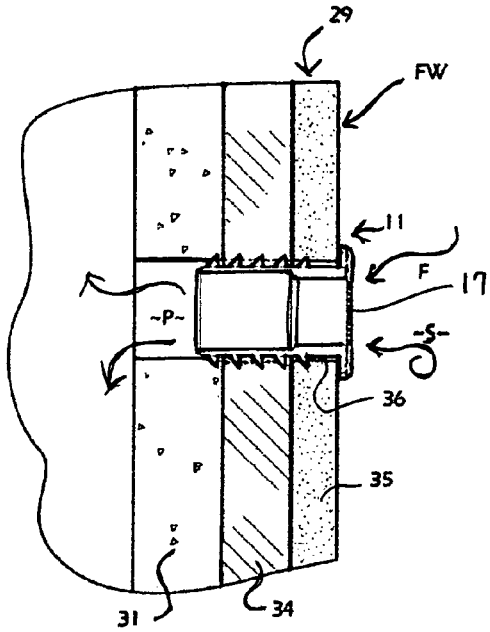
FIG. 8 is a partial sectional view showing an installed venting device in an alternate wall construction.

Referring to FIGS. 7-9 of the drawings, a variety of different wall constructions 29, 30, and 31 can be seen having different effective wall depths requiring different length venting devices. In FIG. 7 of the drawings, a typical cement hollow block 32 is shown in a wall configuration wherein the access opening B is drilled by conventional means (not shown) therein. The primary venting body 11 of the invention with the sealing gasket 18 attached is inserted into the opening B. The free insert end of the venting body 11 has a chamfered end 33 to facilitate ease of installation while the hereinbefore described multiple flexible annular sealing flanges 14 deform assuring a secure frictional fit within the opening B inhibiting transient leakage during thermal and moisture exchange between the communicating interior condition space S of the building and the interior I of the block wall W as indicated by flow arrows F.

In FIG. 8 of the drawings, a finished block wall FW can be seen having the hollow block 32 with a furring strip element 34 and a finish wall board 35 secured thereto. The primary venting body 11 is inserted in an installation opening 36 through the finish wall board 35 and surface of the block 32 aligned therewith. It will be seen that the primary body vent 11 is of sufficient length in this application to engage and seal therebetween forming a communication passage way P.

In FIG. 9 of the drawings, an alternate wall construction is shown the hollow block 32 with a substantial interior from element 37 and the finish wall board 35 secured thereto. This wall construction is of a greatly increased depth requiring the primary venting body 11 to be supplemented by the full extension body 12 as illustrated. The extension body 12 provides the additional length for sealing engagement within the hollow block 32, maintaining a vent passage from the room interior R to within the block 32. In order to effectively vent any of the referred wall configurations, the placement of the hereinbefore described venting bodies 11 and extension 12 is critical.

Figure 10:
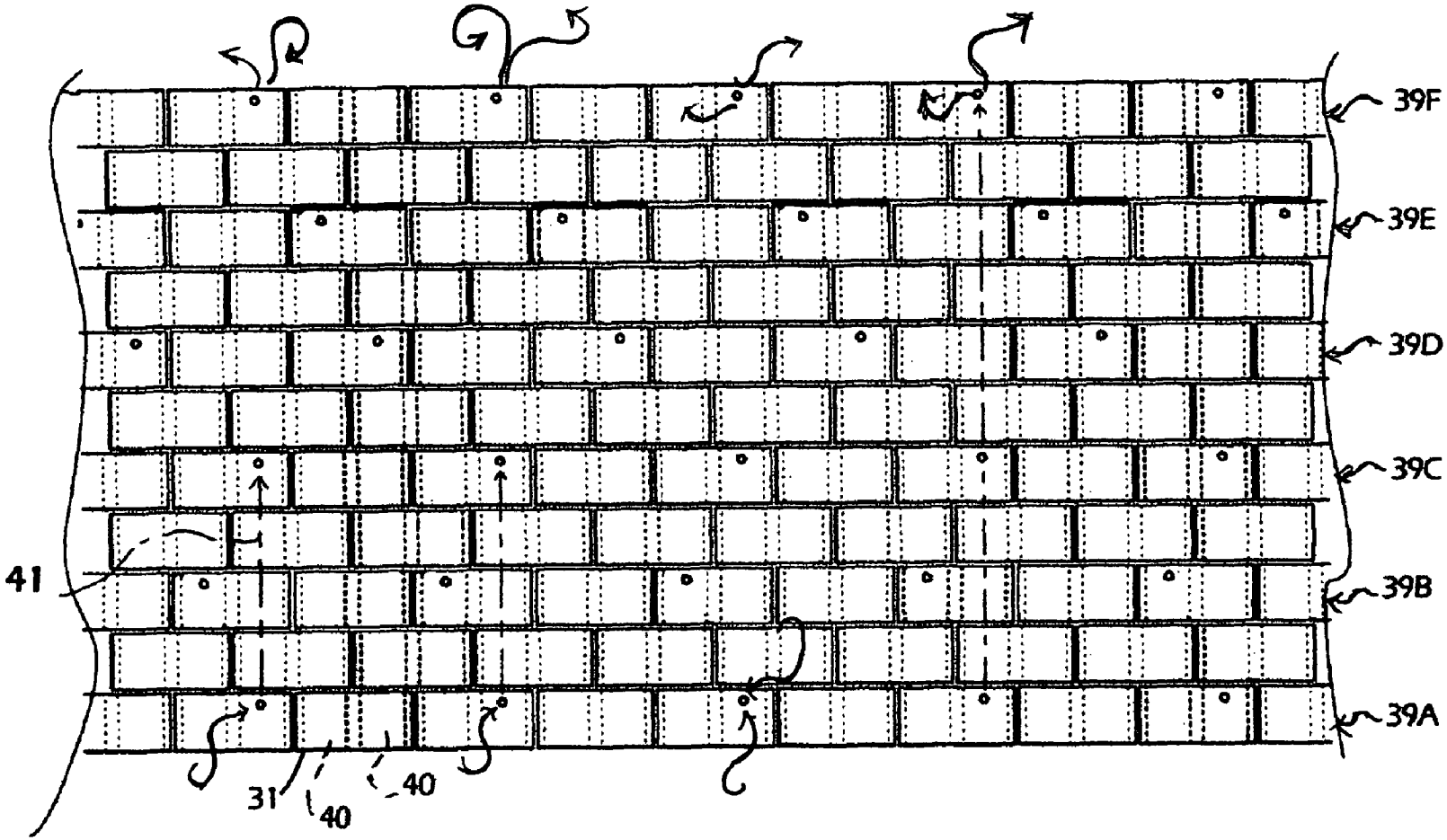
FIG. 10 is a graphic representation of a venting device wall installation pattern in a subterranean wall configuration.

A preferred vent placement orientation is illustrated therefore in FIG. 10 of the drawings in which a hollow block wall 38 construction having staggered multiple horizontal lock rows 39 is shown. Given the typical construction as illustrated, each of the blocks 31 have a pair of internal open chambers 40 extending vertically there through. The staggered horizontal multiple rows 39 therefore form natural vertical interconnected passageways 41 illustrated in broken lines.

The vent devices 10 of the invention are placed in a first exposed block bottom row 39A in every other adjacent block 32 therein.

The next set of vent devices 10 are installed in alternate vertically ascending block rows 39B, C, D, and E.

Given the staggered block placement in a typical block wall construction, adjacent rows will be seen that the vents 10 accordingly intersect and communicate with the so-formed natural vertical block passageways 41 allowing for thermal convection venting there through, illustrated by the vent channel arrows, and joined and broken lines.

It will be seen that by using multiple venting devices 10 of the invention that its primary vent body 11 and alternate attachable extension vent body 12 when needed that multiple effective airflow and moisture communication paths can be established in a variety of different subterranean wall construction configurations. Given the strategic placement pattern of the vents of the invention in alternate block rows and corresponding alternate blocks horizontally within said rows, as hereinbefore described, a unique effective venting system of the invention can be quickly and easily established assuring proper ventilation of multiple types of walls within these environments.

It will thus be seen that a new and novel subterranean basement wall venting system has been illustrated and described and it will be apparent to those skilled in the art that various changes and modifications may be made therein without departing from the spirit of the invention, therefore I claim.

The invention claimed is:

1. A wall venting system for venting subterranean block walls, said venting system comprises:

venting devices, wherein each venting device comprises a tubular vent body having an annular sealing flange on one end thereof and oppositely disposed beveled end, a plurality of thin flexible angular disposed independent sealing flanges in longitudinal parallel spaced relation to one another on one end of said vent body, said sealing flanges are angularly disposed in relation to the axis of said tubular body, a vent lattice mesh formed within an opening defined by said annular sealing flange, a gasket on said vent body registerable against said surface sealing flange, and adjustable tubular extension for said venting device having an area of reduced annular dimension, registered within said beveled end, an annular channel in said tubular extension defining, a cutting guide, said tubular venting body and said extension body member are of synthetic resin material;

and said venting devices are placed in alternate blocks in each horizontal row of a subterranean block wall and in corresponding vertical alignment in alternating ascending horizontal rows of said subterranean block wall such that interior vertical venting passages of said blocks of said subterranean block wall are in communication with said venting devices.

* * * * *